US006932361B2

(12) United States Patent
Steinhauser, Jr.

(10) Patent No.: US 6,932,361 B2
(45) Date of Patent: Aug. 23, 2005

(54) SKATE WITH REMOVABLE BLADE

(76) Inventor: Paul M. Steinhauser, Jr., 1364 Hillside Dr., Davision, MI (US) 48423

( * ) Notice: Subject to any disclaimer, the term of this patent is extended or adjusted under 35 U.S.C. 154(b) by 101 days.

(21) Appl. No.: 10/194,537

(22) Filed: Jul. 12, 2002

(65) Prior Publication Data

US 2002/0175481 A1 Nov. 28, 2002

Related U.S. Application Data

(63) Continuation-in-part of application No. 10/054,271, filed on Jan. 21, 2002, now Pat. No. 6,623,017, which is a continuation-in-part of application No. 09/602,944, filed on Jun. 26, 2000, now Pat. No. 6,364,321.

(51) Int. Cl.[7] ..... A63C 1/99

(52) U.S. Cl. ..... 280/11.18; 280/11.12; 280/11.17

(58) Field of Search ..... 280/11.18, 11.17, 280/11.12, 11.3, 11.31, 11.32, 11.34, 11.27, 7.13, 841

(56) References Cited

U.S. PATENT DOCUMENTS

| | | | | | |
|---|---|---|---|---|---|
| 2,150,964 | A | | 3/1939 | Dornseif | |
| 3,552,746 | A | * | 1/1971 | Nagin | 472/90 |
| 4,074,909 | A | * | 2/1978 | Baikie | 280/11.12 |
| 4,131,288 | A | * | 12/1978 | Wilson | 280/11.17 |
| 4,139,209 | A | * | 2/1979 | Humphreys | 280/11.12 |
| 4,150,499 | A | | 4/1979 | Wang | |
| 4,218,069 | A | | 8/1980 | Baikie | |
| 4,314,708 | A | | 2/1982 | Zuuring | |
| 4,336,948 | A | | 6/1982 | Couture | |
| 5,088,749 | A | * | 2/1992 | Olivieri | 280/11.18 |
| 5,129,663 | A | | 7/1992 | Soo | |
| 5,248,156 | A | | 9/1993 | Cann et al. | |
| 5,320,366 | A | | 6/1994 | Shing | |
| 5,332,242 | A | | 7/1994 | Cann et al. | |
| 5,383,674 | A | | 1/1995 | Cann et al. | |
| 5,388,845 | A | * | 2/1995 | Soo | 280/11.17 |
| 5,484,148 | A | * | 1/1996 | Olivieri | 280/11.18 |
| D373,399 | S | | 9/1996 | Both | |
| 5,595,392 | A | | 1/1997 | Casillas | |
| 5,641,169 | A | * | 6/1997 | Bekessy | 280/11.18 |
| 5,662,338 | A | | 9/1997 | Steinhauser, Jr. | |
| 5,810,368 | A | | 9/1998 | Steinhauser, Jr. | |
| 5,839,734 | A | | 11/1998 | Steinhauser, Jr. | |
| 5,845,927 | A | | 12/1998 | Steinhauser, Jr. | |
| 6,045,143 | A | | 4/2000 | Wrike | |
| 6,065,758 | A | | 5/2000 | Steinhauser, Jr. | |
| 6,109,622 | A | | 8/2000 | Reynolds | |
| 6,164,667 | A | | 12/2000 | Olivieri | |
| 6,217,035 | B1 | | 4/2001 | Steinhauser, Jr. | |
| 6,364,321 | B1 | * | 4/2002 | Steinhauser, Jr. | 280/11.18 |
| 6,382,638 | B1 | * | 5/2002 | Lee | 280/7.13 |
| 6,485,033 | B2 | * | 11/2002 | Nicoletti et al. | 280/11.18 |
| 6,623,017 | B1 | * | 9/2003 | Steinhauser, Jr. | 280/11.18 |
| 2002/0140186 | A1 | * | 10/2002 | Nicoletti et al. | 280/11.18 |
| 2002/0175481 | A1 | * | 11/2002 | Steinhauser, Jr. | 280/11.18 |
| 2002/0190487 | A1 | * | 12/2002 | Blankenburg et al. | 280/11.12 |
| 2003/0011150 | A1 | * | 1/2003 | Goldsmith et al. | 280/11.18 |
| 2003/0155724 | A1 | * | 8/2003 | Wang et al. | 280/11.3 |

FOREIGN PATENT DOCUMENTS

| | | | | |
|---|---|---|---|---|
| AT | 92/00132 | * | 4/1993 | A63C/17/18 |
| US | 89/03011 | * | 1/1990 | A63C/1/22 |

* cited by examiner

*Primary Examiner*—Brian L. Johnson
*Assistant Examiner*—J. Allen Shriver

(57) ABSTRACT

A skate that includes a boot fixed between an insole and an outsole. The insole has at least one retainer projecting through an aperture in the outsole. The retainer extends into an interior chamber formed in a blade holder. An adapter is mounted in a recess in the blade and extends to an opposite end received in the retainer. A fastener is extendable through aligned bores in the holder, the adapter and the retainer to fixedly connect the blade and the holder and the insole of the boot.

25 Claims, 11 Drawing Sheets

SKATE WITH REMOVABLE BLADE

CROSS REFERENCE TO CO-PENDING APPLICATION

This application is a continuation-in-part of application Ser. No. 10/054,271, filed Jan. 21, 2002, now U.S. Pat. No. 6,623,017, which is a continuation-in-part of U.S. patent application Ser. No. 09/602,944, filed Jun. 26, 2000, now U.S. Pat. No. 6,364,321, both entitled "Skate With Removable Blade", the entire contents of both of which are incorporated herein by reference.

BACKGROUND

The present invention relates, in general, to skates.

Skates, whether of the ice skate, roller skate or in-line variety, typically include a boot, a use element, such as an ice blade, rollers, or in-line rollers as well as a use element holder which receives the use element and is attachable to the boot.

Typically, a plurality of rivets are used to fixedly attach the holder to the boot sole. In the case of ice skates, the riveted attachment of the holder and blade requires that the entire boot, blade holder and blade be held or mounted in a fixture for sharpening in a blade sharpening machine. Due to the size of the ice skate, this is difficult to do in a manner which insures that the blade is held stationary during the entire sharpening process for the formation of a consistent edge.

In use, skates are subject to frequent start and stops. This generates high lateral torque forces which are transmitted to the rivets and which frequently result in breakage or damage of the rivets. This requires frequent replacement of the rivets which, at best, is a time-consuming process and renders the skate inoperative for the length of the repair process.

In ice hockey skates, a blade holder is commonly used to fixedly mount an ice runner or blade to an ice skate boot. The blade holder is formed with enlargements and recesses which receive the head of a shank of a fastener. An opposite threaded end of the shank extends into a recess in the holder where a nut is mounted in a recess on the inside of the holder to secure the shank and the attached blade to the blade holder. Rivets are then applied to the peripheral edge of the blade holder to fixedly secure the blade holder and the attached blade to the boot sole.

However, repair or replacement of such a blade requires the removal of the numerous rivets to separate the blade holder from the boot in order to enable access to and removal of the nut to release the runner or blade from the blade holder. The process must be repeated in a reverse order to attach a new blade or a sharpened blade to the blade holder and the blade holder back on the boot sole.

It is believed that skates can be further improved relative to the blade holder and the replaceable blade.

SUMMARY

The present invention is a skate which provides a simplified, quick and easy mounting of a replaceable blade to a blade holder and the blade holder to the boot which does not require any rivets between the blade holder and the boot as in previous skate constructions.

In one aspect of the invention, the skate includes a boot having an insole disposed within the boot and an outsole mounted exteriorly the boot. At least one retainer extends from the insole through the outsole. Bores are formed in the retainer transverse to the length of the insoles. The holder is engagable with the outsole and has interior chambers receiving the retainer of the insole, and an open ended groove formed in a bottom portion which has apertures opening into the interior chambers.

A blade has a runner portion mountable in the open ended groove of the holder. Enlargements on the blade runner have an attachment receptacle which receives an enlarged head at one end of an attachment fastener. The fastener can be a unitary, one piece, fixed length fastener or a two part, threadingly engagable fastener. In either aspect, the other end of the fastener has a through bore which is received within the retainer extending from the boot sole for receiving a fastener to secure the blade holder and the replaceable blade to the boot. Such an attachment is via any of the means described above for attaching the fastener and the blade holder to the retainer. A fastening pin is extendable through the aligned bores in the holder, the one end of the legs of the blade, and the first and second retainers to securely connect the blade to the holder and the holder to the boot.

The fastening pin preferably carries at least one or optionally two biased lock members, such as spring biased balls, which normally project outwardly from an exterior surface of the pin for forced engagement with end portions of the bores in the holder when the pin is mounted in the holder. The lock members securely fix the pin in the holder to couple the blade to the holder and the holder to the boot.

In one aspect, the fastening pin has spring biased lock members or balls carried at opposite ends of the pin. In yet another aspect, the pin carries a single biased lock member or ball at one end and a pull member or ring at an opposite end to facilitate pulling removal of the pin from the skate.

In one aspect of the invention, a plurality of complementary shaped projections and recesses are formed on one of or both of the outsole and the holder for mating when the holder is engaged with the outsole. The projections and recesses define surfaces which resist lateral as well as fore and aft movement of the holder relative to the outsole without the need for a recessed cavity in the outsole or rivets to fix the holder to the outsole of the boot.

The skate of the present invention provides a unique, quick and expedient structure for attachment of a replaceable blade to a blade holder as well as the blade holder to a boot by means of the same fasteners. This simplifies the assembly of the skate as well as any removal or replacement of the blade from the blade holder by eliminating the need for rivets used in practically all previously devised skates.

BRIEF DESCRIPTION OF THE DRAWINGS

The various features, advantages and other uses of the present invention will become more apparent by referring to the following detailed description and drawing in which.

DETAILED DESCRIPTION

Figure 1:
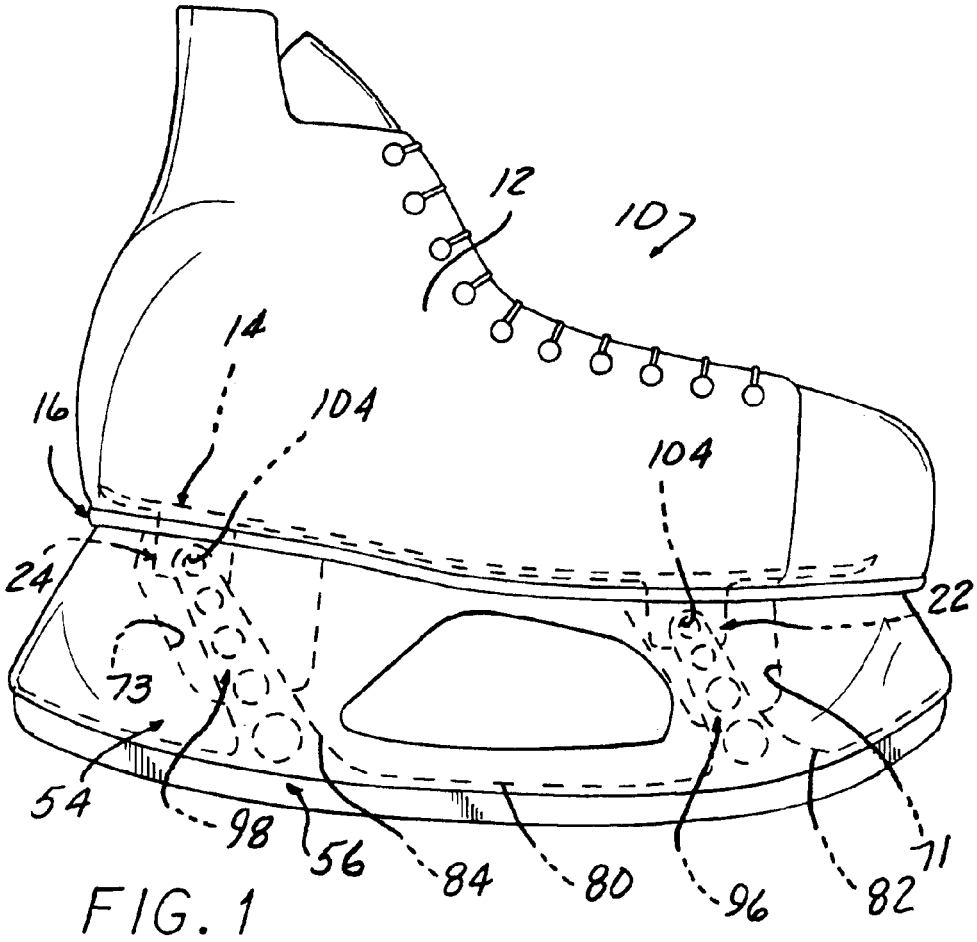
FIG. 1 is a side elevational view of a skate constructed in accordance with one aspect of the present invention and depicted as an ice skate.

Referring now to the drawing and to FIGS. 1–6 and 8 in particular, there is depicted a skate 10 constructed in accordance with the teachings of the present invention. The skate 10, although depicted as an ice skate, can also be devised for use as an in-line skate or roller skate.

As is conventional, the skate 10 includes a shoe body or boot 12 of conventional construction. The boot 12 may be formed of any suitable shoe or boot material, such as leather, rigid or soft plastic, combinations thereof as well as other suitable boot materials.

Figure 3:
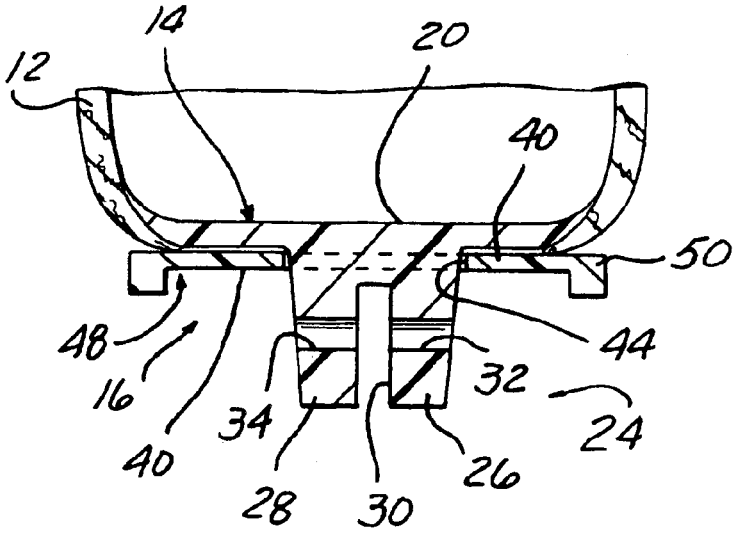
FIG. 3 is a partial, cross-sectional view showing the mounting of the boot, insole and outsole.
Figure 2:
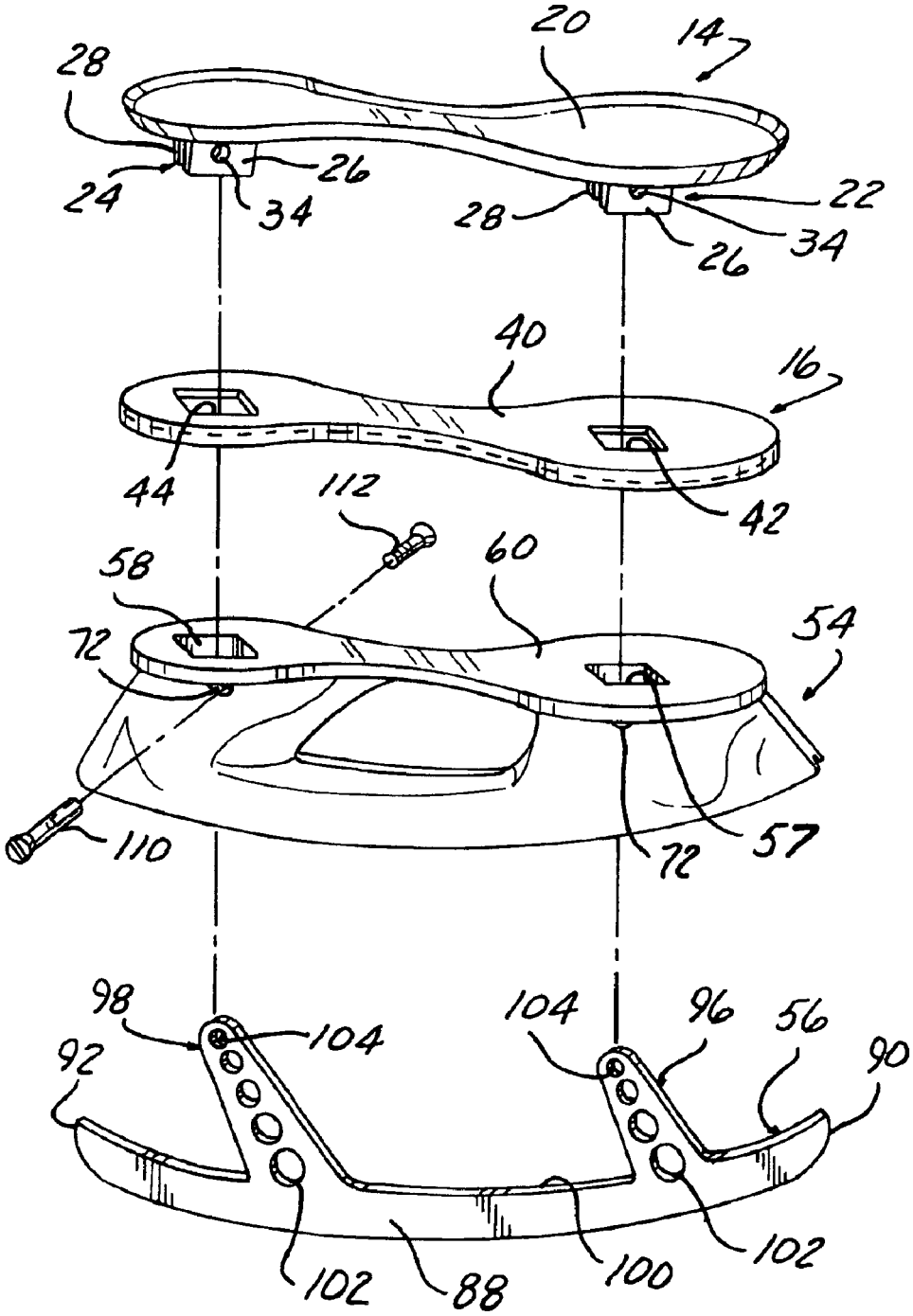
FIG. 2 is an exploded, perspective view of the skate shown in FIG. 1, with the boot not shown.
Figure 4:
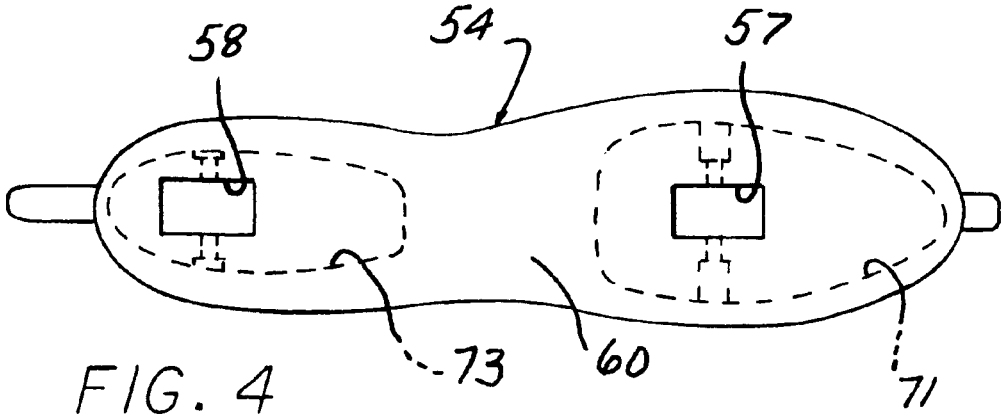
FIG. 4 is a plan view of the holder shown in FIGS. 1 and 2.
Figure 5:
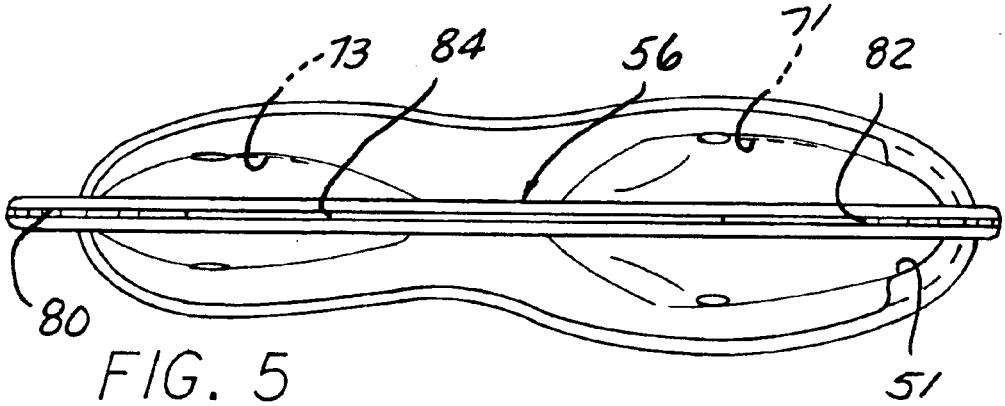
FIG. 5 is a bottom view of the holder depicted in FIG. 4 shown attached to the boot.

As shown in FIGS. 1–3, the boot 12 also includes an insole 14 and an outsole 16 which have center portions which sandwich inward extending bottom edges of side walls of the boot 12 there between. Adhesive and/or fasteners are employed to securely join the boot 12, insole 14 and outsole 16 together.

In this aspect of the present invention, the insole 14 is formed with a center portion 20 which is positioned inside of the boot 12 as a surface on which the user's foot rests. The insole 14 is formed with at least one and, preferably two spaced retainers 22 and 24, with the retainer 22 disposed in the toe portion of the insole 14 and the retainer 24 disposed in the heel portion of the insole 14. The retainers 22 and 24 are substantially identically formed and may be attached to or integrally formed, such as by molding, with the center portion 20 of the insole 12 and project from one surface of the center portion 20. In the case of only one retainer on the insole 14, the single retainer would typically be substantially centrally located between the toe and heel of the insole 14.

Figure 6:
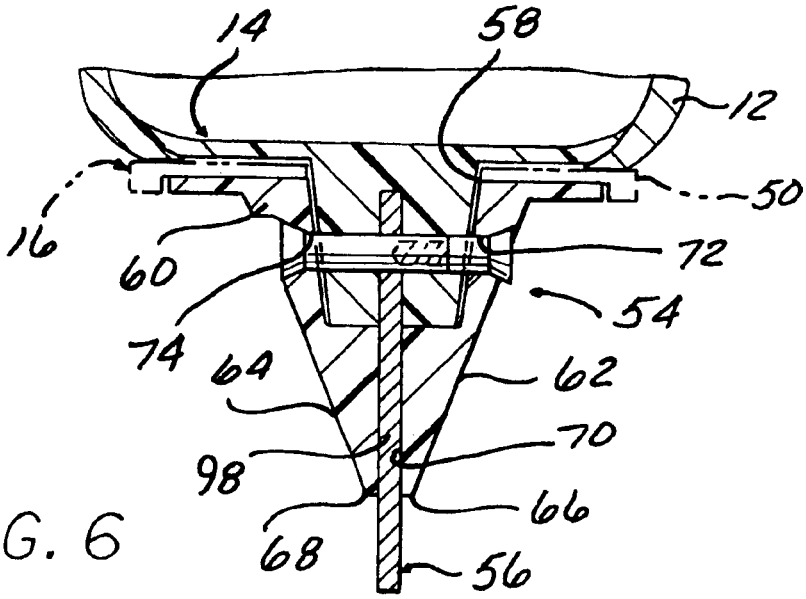
FIG. 6 is a cross-sectional, end view of the assembled boot, insole, outsole, holder and blade.

As shown more clearly in FIGS. 3 and 6, the retainer 24 is formed of a pair of depending legs 26 and 28 which project from the center portion 20 of the insole 14 and are spaced apart by a central slot 30. Through bores 32 and 34 formed of each of the legs 26 and 28, respectively, and are aligned for receiving a fastener there through, as described hereafter.

It will be understood that the retainer 22 is similarly formed of spaced legs 26 and 28, with aligned bores 32 and 34 extending there through.

The outsole 16 has a center portion 40. The first aperture or slot 42 is formed in a toe portion of the outsole 16; while a second aperture or slot 44 is formed in a heel portion of the outsole 16.

In this aspect of the invention, a recessed cavity denoted by reference number 48 is formed within the periphery of the outsole 16 by the formation of a lip 50 depending from a peripheral edge of the center portion 40 of the outsole 16. The lip 50 preferably depends from the entire peripheral extent of the outsole 16, but may be provided with discontinuous heel and toe portions. A toe cup 51 at the toe end of the outsole 16 is formed by an inward extending flange perpendicular to the lip 50 and spaced from the center portion of the outsole 16 to form a recess for the toe end of a holder.

When the boot 12, insole 14 and outsole 16 are joined together, as described above, by means of an adhesive and/or fasteners, the retainers 22 and 24 project through the apertures 42 and 44, respectively, in the outsole 16 and depend a greater distance from the center portion 40 of the outsole 16 than does the extent of the lip 50.

A use element holder 54 is provided for receiving a use element, such as an ice blade or runner in the present example of the invention as an ice skate. The holder 54 is, according to the construction of the skate of the present invention, fixedly, yet removably attached to the insole 14 and the outsole 16 in a manner which resists lateral and fore and aft movement relative to the outsole 16.

According to this aspect of the present invention, the holder 54 is formed as a one piece body, generally of molded plastic. Two internal chambers 71 and 73 are formed in toe and heel portions, respectively, of the holder 54 extending inward from apertures 57 and 58, formed in a top surface 60 of the holder 54. As shown more clearly in FIG. 6, the holder 54 is formed with a pair of side walls 62 and 64 which extend from the top surface 60 and taper inwardly to bottom ends 66 and 68, respectively, which are spaced apart by a slot 70 which extends completely through the lower portion of the holder 54 and opens into each internal chamber 71 and 73 within the holder 54. Co-axial through bores 72 and 74 are formed through the side walls 62 and 64 below the top portion 60 of the holder 54.

As shown in FIG. 1, the bottom edges 66 and 68 of the side walls 62 and 64, respectively of the holder 54 are spaced apart along their length to define a shallow slot 80. Two apertures 82 and 84 are formed on an inner edge of the slot and open to the interior chambers 71 and 73 in the holder 54.

According to this aspect of the present invention, the use element or blade 56 is formed with an elongated runner portion 88 which extends from a toe end 90 to a heel end 92. Typically, the blade 56 is formed of metal, such as stainless steel. A pair of attachment legs 96 and 98 are integrally formed with the runner 88 and project from an upper surface 100.

In this aspect of the invention, each leg 96 and 98 extends angularly from the top edge 100 of the runner 88 as shown in FIG. 2. Weight reducing apertures 102 may optionally be formed in each leg 96 and 98 to produce the overall weight of the blade 56.

The attachment of the blade 56 to the holder 54 and, at the same time, the attachment of the holder 54 to the insole 14 and outsole 16 will now be described. After the boot 12, the insole 14 and the outsole 16 have been fixedly joined together, as shown in FIG. 3 and then described above, the holder 54, with or without the blade 56 disposed therein, is urged into engagement with the outsole 16. In this mounting arrangement, the outer periphery of the center portion 60 of the holder 54 has a shape complimentary to the shape of the inner surface of the depending lip 50 on the outsole 16, as shown in FIG. 6. This holds the center portion 60 of the holder 54 in snug engagement with the entire peripheral surface of the lip 50 on the outsole 16 to prevent lateral and fore and aft movement of the holder 54 relative to the outsole 16.

With the holder 54 snugly engaged with the outsole 16, as shown in FIG. 6, the retainers 22 and 24 project through the apertures 42 and 44 in the outsole 16 and into the interior chambers 71 and 73, respectively, in the holder 54.

The blade 56 is then be attached to the holder 54 and to the insole 14 by sliding the legs 96 and 98 through the apertures 82 and 84, respectively, extending inward from the inner edge 80 of the slot 70 formed in the lower end portion of the holder 54 until an upper end of each of the legs 96 and 98 is aligned with the bores 72 and 74 in the holder 54 and with the bores 32 and 34 in the legs 26 and 28 of each retainer 22 and 24. A fastener formed of two mating fastener portions 110 and 112 is then inserted through the aligned bores and threadingly tightened to fixedly mount the blade 56 in the holder 54 and at the same time to attach the blade 56 to the insole 14 and to also attach the holder 54 to the insole 14.

Figure 23:
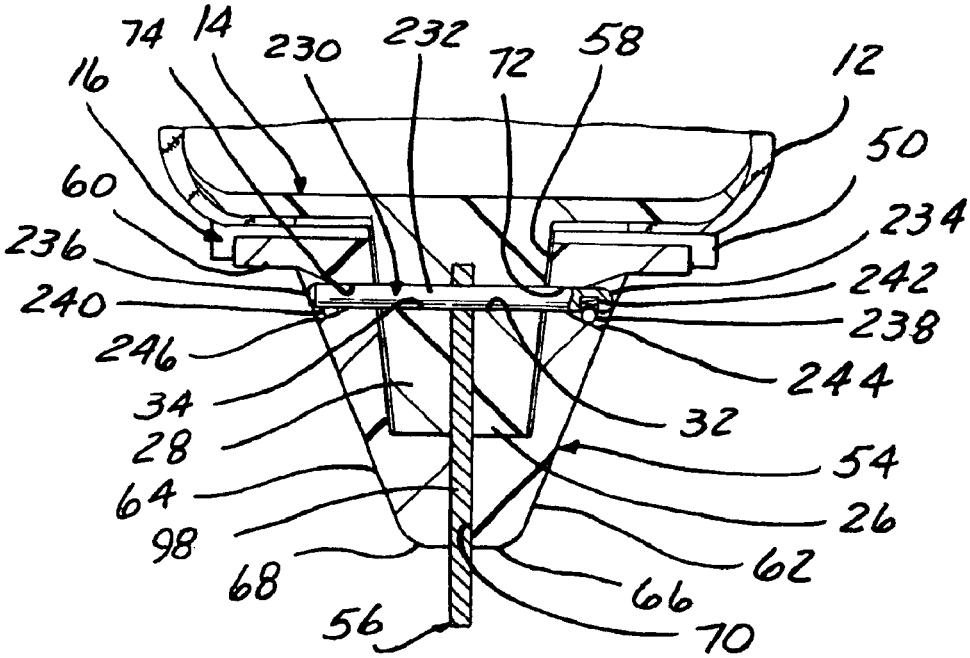
FIG. 23 is a cross-sectional end view of another aspect of the assembled boot, insole, outsole, holder and blade showing one aspect of a removable pin fastener.
Figure 24:
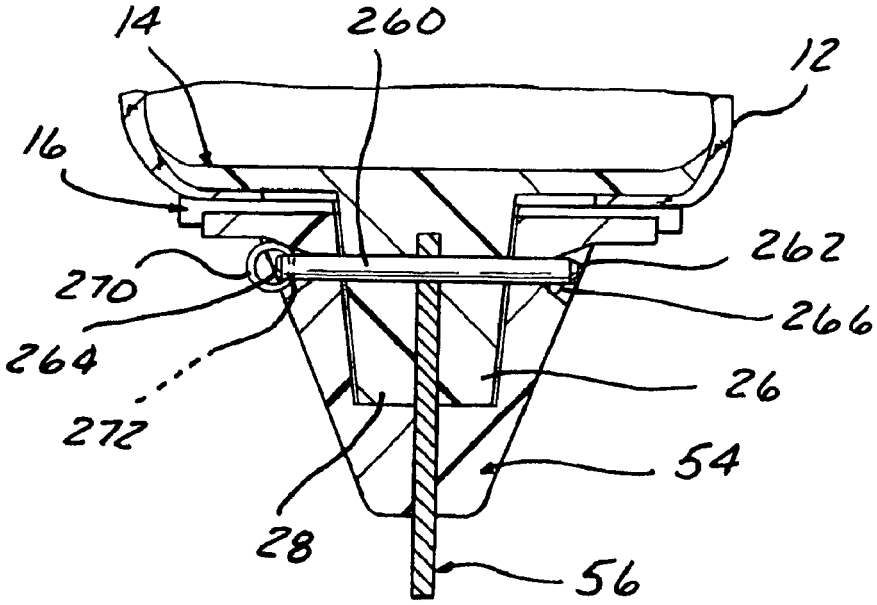
FIG. 24 is a cross-sectional end view of another aspect of the assembled boot, insole, outsole, holder and blade showing another aspect of a removable pin fastener.

Referring now to FIGS. 23 and 24, there is depicted other aspects of the fastener used to mount the blade 56 in the holder 54 and the holder 54 to the retainers 22 and 24. As shown in one aspect in FIG. 23, a fastener 230 is insertable through the aligned bores 32 and 34 in the legs 26 and 28 of each retainer 22 and 24, respectively. The fastener 230, in this aspect of the invention, is in the form of a single, elongated pull or quick release pin. The pin 230 has an elongated shaft 232 with opposed first and second ends 234 and 236. Lock members in the form of spring biased balls 238 and 240 are movably mounted in bores formed adjacent the first and second ends 234 and 236 in the shaft 232. As shown in FIG. 23, each ball 238 and 240 is captured in the shaft 232 such that only a portion of each ball 238 and 240 is biased outwardly of the outer surface of the shaft 232 by an internally mounted spring 242.

When the pin 230 is forcibly inserted through the aligned bores 32 and 34 in the retainers 22 and 24 and the bores 72 and 74 in the holder 54, the balls 238 and 240 will be disposed in enlarged end portions of the bores 72 and 74 in the holder 54. The enlarged end portions may have a conical shape as shown in FIG. 23. The spring force of the springs 242 is selected so as to apply sufficient biasing force to maintain the balls 238 and 240 in secure contact with a surface of the enlarged end portion 244 and 246 of each bore 72 and 74 despite any lateral forces which may be exerted on the pin 230 during use of the skate.

A punch or other tool may be forcibly struck against one of the ends 234 and 236 of the pin 232 to slide the pin from the bores so as to enable separation of the holder 54 from the retainers 22 and 24.

FIG. 24 depicts a modification to the fastener. In this aspect, the fastener 260 is also in the form of a pull or quick release pin manufactured by Pivot Point, Inc. Hustisford, Wis. 53034. The pull pin 260 also has opposed first and second ends 262 and 264. A latch member, such as a spring biased ball 266, is mounted in an internal bore in the shaft 260 adjacent to one of the ends, such as the first end 262.

In this aspect of the invention, the pull pin 260 is formed with a pull member 270, such as a ring, which is mounted in a bore 272 formed in the shaft 260 adjacent the second end 264 of the pin 260.

The pin or fastener 260 functions in the same manner as the pin 232 shown in FIG. 23 in that the pin 260 can be forcibly inserted through the aligned bores in the retainers 22 and 24 and the holder 54 to secure the blade 56 to the holder 54, and at the same time, to secure the holder 54 to the retainers 22 and 24. The fasteners 232 and 260 may be easily removed from the skate by means of a driving force applied to one end 234 or 236 of the pin 232 or a pulling force exerted on the pin 260 through the pull member 270 in the aspect of the invention shown in FIG. 24.

Figure 7:
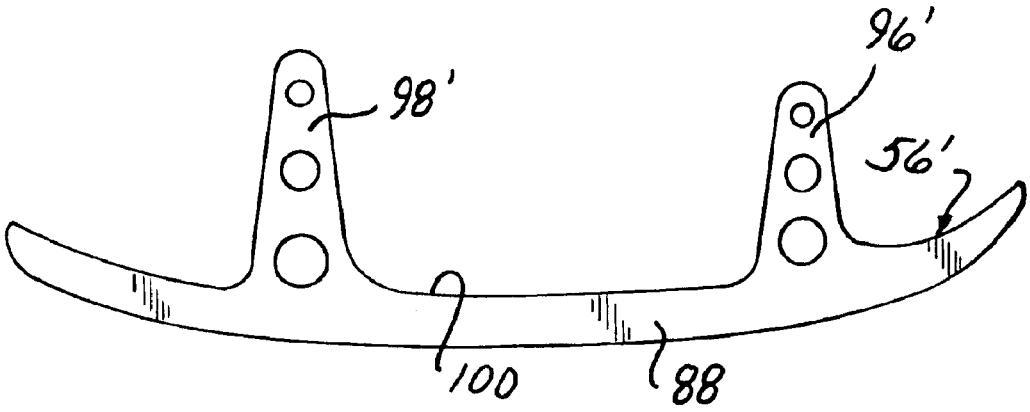
FIG. 7 is a side elevational view of a modified blade according to another aspect of the present invention.
Figure 8:
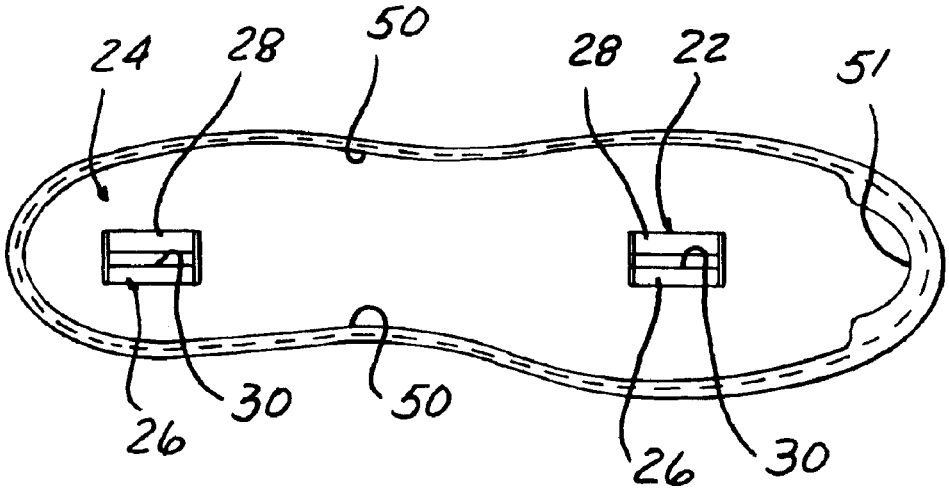
FIG. 8 is a bottom view of the outsole of the skate shown in FIGS. 1–6.

FIG. 7 depicts an alternate blade 56' construction which includes the runner 88 and a pair of legs 96' and 98' extending therefrom. The blade 56' differs from the blade 54 only in that the legs 96' and 98' extend substantially perpendicularly from the top edge 100 of the runner 88 rather than at an angle as the legs 96 and 98 in the blade 56.

This construction for a skate provides advantages over previously devised skate constructions. Of primary import is the attachment of and the blade holder to the skate boot without the need for any rivets. Further, the same attachment used to attach the holder to the boot also attaches the blade to the holder. This facilitates replacement of the blade as necessary for sharpening or repair as well as enabling quick assembly of the blade, the blade holder and the skate boot. At the same time, the blade holder and the blade are prevented from lateral movement relative to the skate boot.

FIGS. 9–21 depict alternate attachment constructions between the holder and the outsole which eliminates the need for the formation of a recessed cavity 48 in the outsole 16 as shown in FIG. 3 for the boot 10. In each of the following aspects of the invention, the boot 12 is constructed in the same manner as described above and shown in FIG. 1. In addition, except for the aspect shown in FIG. 9, the insole 14 is likewise similarly constructed as the insole 14 described and shown above in FIG. 1.

Figure 9:
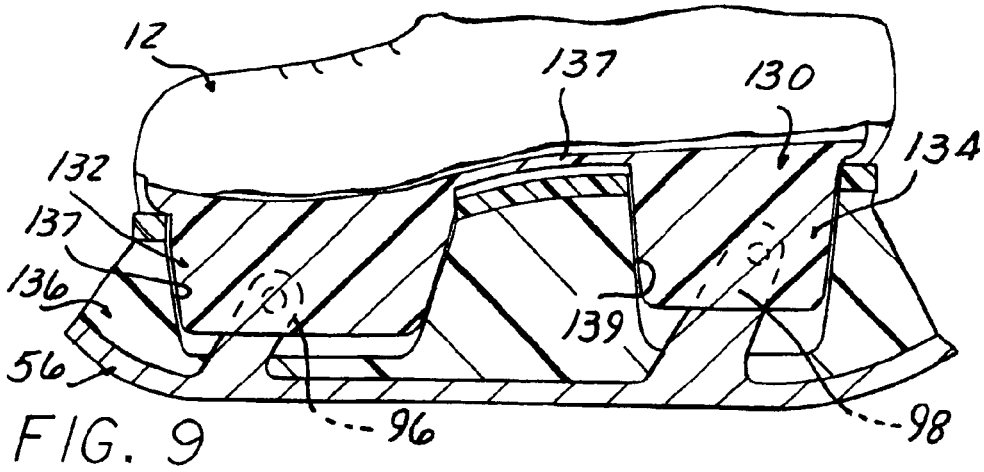
FIG. 9 is a partially broken away, side elevational view of another aspect of a skate according to the present invention.
Figure 10:
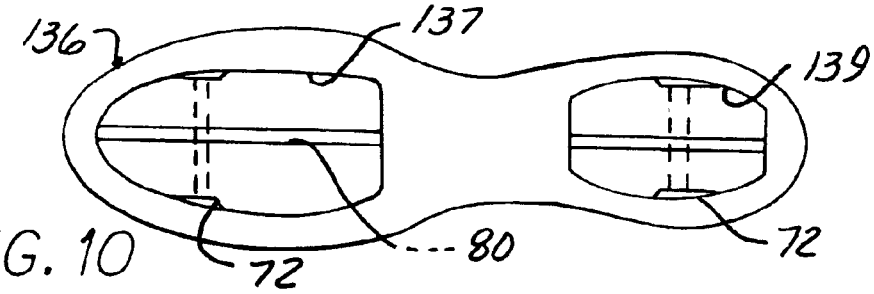
FIG. 10 is a plan view of the holder shown in FIG. 10.

Referring now to FIGS. 9 and 10, there is depicted one aspect of a holder to outsole and insole attachment in which the insole 130 has a pair of retainers 132 and 134, each formed of a pair of spaced legs extending from the toe and heel portions of a center support 137, respectively. The retainers 132 and 134 are similar to the retainers 22 and 24 described above and shown in FIG. 2 except that the overall longitudinal length of each leg of the retainers 132 and 134 is considerably longer from the legs of the retainers 22 and 24 shown in FIG. 1, in order to provide support to prevent lateral movement of a holder 136 relative to the boot 12. Specifically, the legs of the retainer 132 extend lengthwise over substantially the entire toe portion of the insole 130. Likewise, the legs of the retainer 134 extend lengthwise over substantially the entire heel portion of the insole 130.

In this aspect, the holder 136 is similar to the holder 54 shown in FIG. 1 except that the interior chambers 137 and 139 have a considerably longer longitudinal extent to accommodate the longer length retainers 132 and 134. Otherwise, the holder 136 is identical to the holder 54 insofar as having a bottom slot which receives the runner of the blade 56 and internal slots extending from the bottom slot to the interior chambers 137 and 139 for receiving the legs 96 and 98 of the blade 56. Transverse bores extend through the side walls of the holder 136 and are aligned with the bores in the blade arms 96 and 98 and the legs of the retainers 132 and 134 for receiving a fastener to securely attach the blade 56 to the holder 54 and to the retainers 132 and 134 of the insole wall 130. It should be noted that, in this aspect of the skate of the present invention, the outsole has a generally laterally flat bottom surface without a depending peripheral lip 50.

Figure 11:
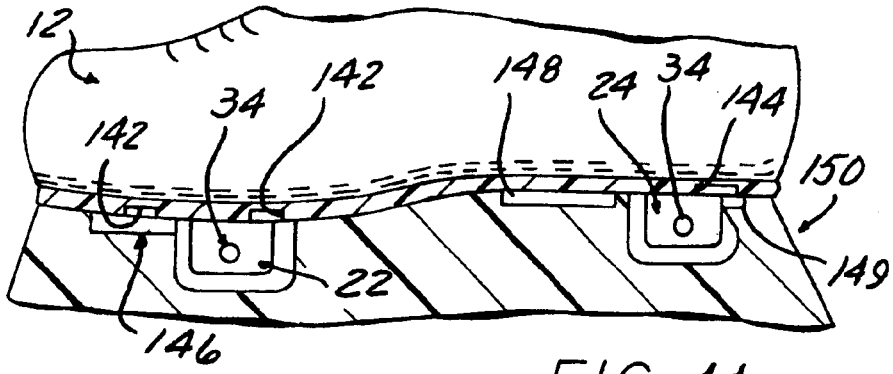
FIG. 11 is a partial, side elevational view of a skate according to another aspect of the present invention.
Figure 12:
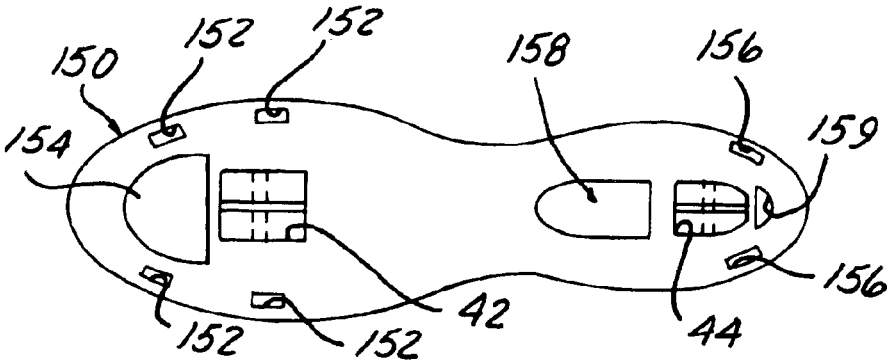
FIG. 12 is a plan view of a holder usable in the skate shown in FIG. 11.

Another aspect of the present invention is shown in FIGS. 11 and 12 in which the outsole 140 is formed with a plurality of inward extending recesses arranged in a plurality of recesses 142 inward of the periphery of the toe portion of the outsole 142 and a smaller number of recesses 144 spaced inward from the periphery of the heel portion of the outsole 140.

A plurality of outward extending, large dimension projections 146 and 148 are respectively formed in the toe portion and heel portion of the outsole 140. The projections 146 and 148 are preferably disposed along the longitudinal center line of the outsole 140 and are disposed centrally inside of the outer peripheral recesses 142 and 144, respectively. As shown in FIG. 11, the projections 146 and 148 are disposed longitudinally adjacent to the retainers 22 and 24, respectively. A second smaller projection 149 is formed in the heel portion of the outsole 140.

A holder 150 has a complimentary shape to the periphery of the outsole 140 and has a plurality of outwardly extending projections 152 disposed about the periphery of the toe portion of the holder 150 and sized and arranged to fit within the recesses 142. A large recess 154 is also formed in the holder 150 immediately adjacent to the aperture 42 leading to one of the interior chambers within the holder 150.

Similarly, projections 156 are formed on the heel portion of the holder 150 and engages recesses 144 located on the heel portion of the outsole 140. A single large recess 158 is formed in the heel portion of the holder 150 immediately adjacent to the aperture 144 opening to the other interior chamber in the holder 150 and shaped complimentary to the projection 148 on the outsole 140. A smaller recess 159 is adjacent to the opposite edge of the aperture 144 for receiving the projections 149 on the outsole 140.

It will be understood that the construction of the recesses 142 and the projections 152, the recesses 144 and the projections 156, the projections 146 and 148 and the complimentary recesses 154 and 158 may be reversed such that recesses and projections in the outsole 140 may be constructed as recesses and projections on the holder 150.

This arrangement provides for interconnection of the holder 150 to the outsole 140 via the fastener, blade legs and retainers in a manner which minimizes lateral movement of the holder 150 relative to the outsole 140 and the boot 12; but does include a recessed cavity in the outsole 140 formed by the depending lip 50 in the first aspect of the invention described above.

Figure 13:
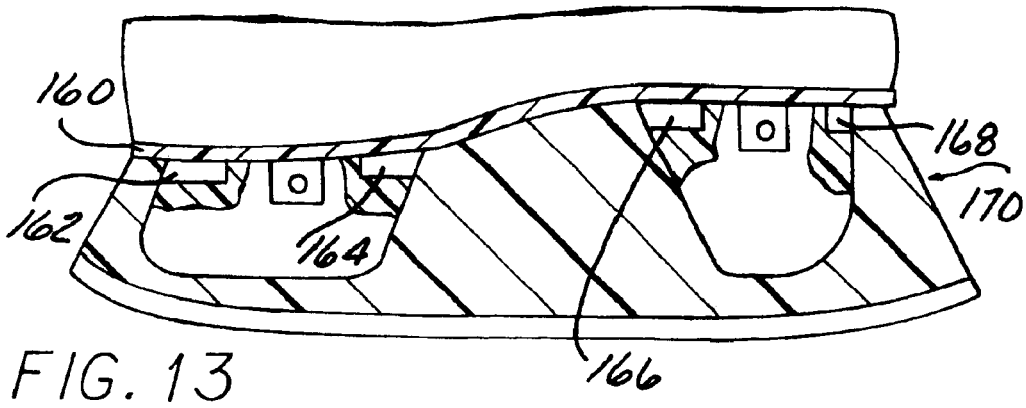
FIG. 13 is a side elevational view, partially broken away, of a skate according to another aspect of the present invention.
Figure 14:
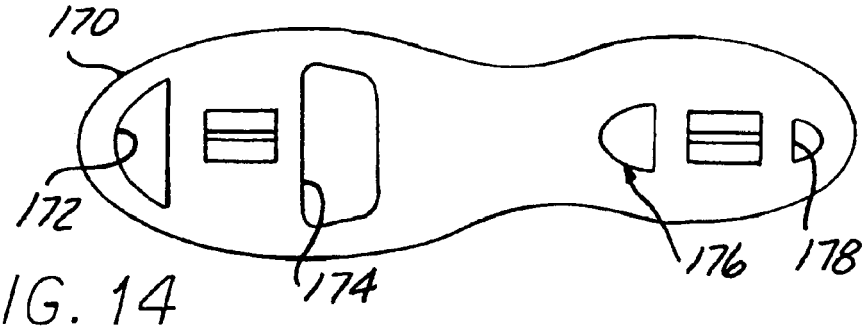
FIG. 14 is a plan view of the holder for the skate shown in FIG. 13.

Yet another aspect of a skate according to the present invention is shown in FIGS. 13 and 14. This aspect also provides for interconnection of an outsole 160 and a holder 170 in which a pair of large size projections 162 and 164, of the same or different shape are formed in the toe portion of the outsole 160. A pair of the same or different shaped projections 166 and 168 are similarly formed in the heel portion of the outsole 160.

The holder 170 with a toe located pair of recesses 172 and 174 which are complimentary in shape to the projections 162 and 164. Similarly, a pair of heel located recesses 176 and 178 are formed complimentary to the projections 166 and 168 for mating engagement therewith. It will also be understood that the projections on outsole 160 may be reformed as recesses and the recesses in the holder 170 may be formed as mating projections.

Figure 16:
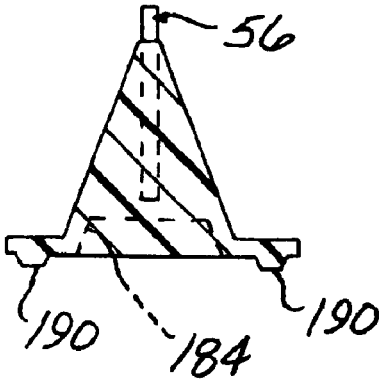
FIG. 16 is a cross-sectional view generally taken along line 16—16 in FIG. 15.
Figure 17:
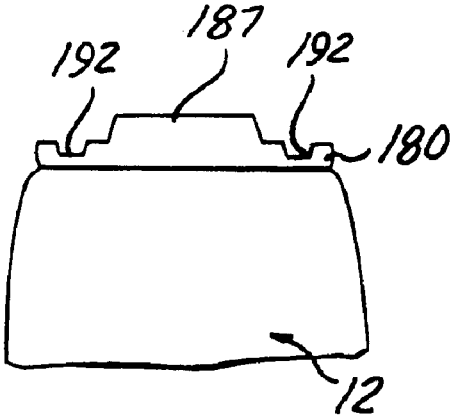
FIG. 17 is an end elevational view of a boot and outsole usable with the holder shown in FIGS. 15 and 16.
Figure 15:
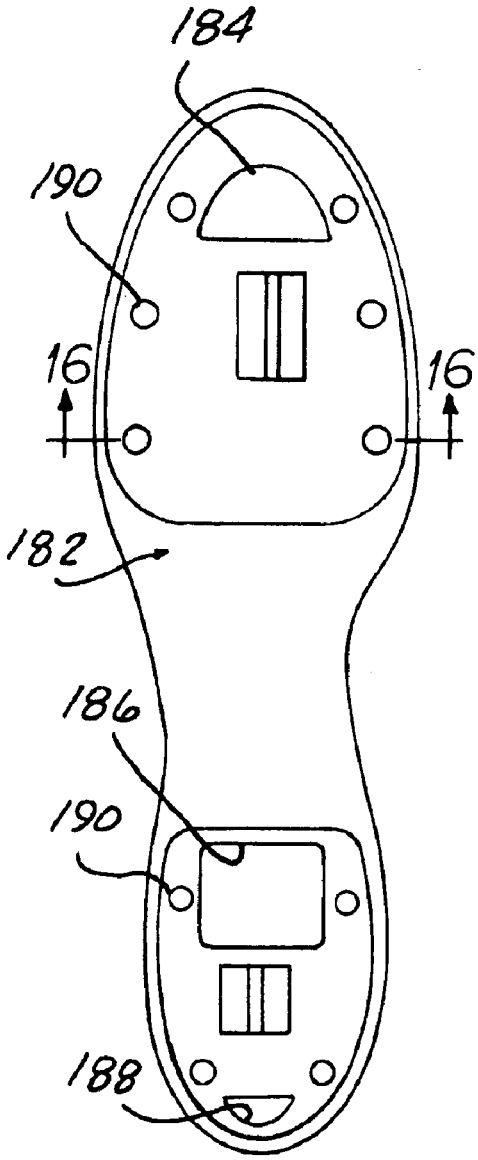
FIG. 15 is a plan view of an outsole according to another aspect of the present invention.

In FIGS. 15–17, another aspect of an outsole 180 to a holder 182 connection is the depicted. The holder 182 is formed with a toe recess located 184 which is complimentary constructed to a projection, not shown, on the outsole 180 in the same manner as described above and shown in FIGS. 11–14. Similarly, at least one and optionally a pair of recesses 186 and 188 are formed at the heel portion of the holder 182 to receive a like-shaped projections 187, etc., on the heel portion of the outsole 180.

In this aspect of the invention, a plurality of peripherally positioned, generally round locators 190 extend from in the heel portion and the toe portion of the holder 182. The locators 190 engage mating recesses 192 formed about the periphery of the outsole 180. The locators 190 and the recesses 192 as well as the mating recesses 184, 186 and 188 and projections 187 securely locate the holder 182 to the outsole 180 to prevent any substantial lateral movement between the holder 182 and the outsole 180.

Figure 18:
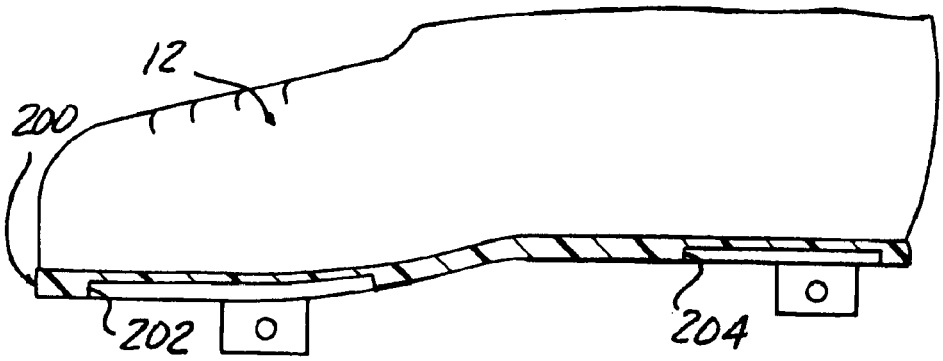
FIG. 18 is a side elevational view of a boot and outsole of a skate according to another aspect of the present invention.
Figure 19:
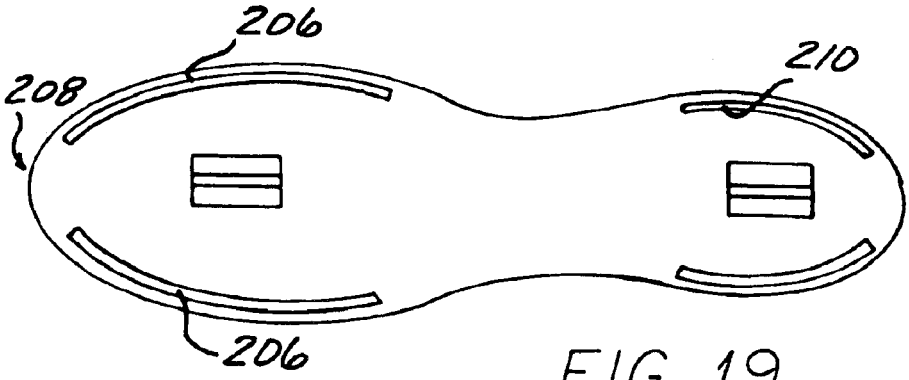
FIG. 19 is a plan view of a holder usable with a boot and outsole shown in FIG. 18.

In the aspect of the invention shown in FIGS. 18 and 19, an outsole 200 is formed with strip-like toe and heel recesses 202 and 204 which mate with a pair of complimentary shaped projections 206 in the toe portion of a holder 208 and a pair of heel located projections 210, respectively. The projections on the holder 208 are disposed inboard of the peripheral edge of the holder 208 and extend from one end of the holder 208 to a central portion of the holder 208. As in prior aspects, the projections can be formed in an outsole 200 and the recesses in the holder 208.

As shown in FIGS. 18 and 19, the mating projections and recesses have a discontinuity formed along the longitudinal axis of the outsole 200 and the holder 208.

Figure 21:
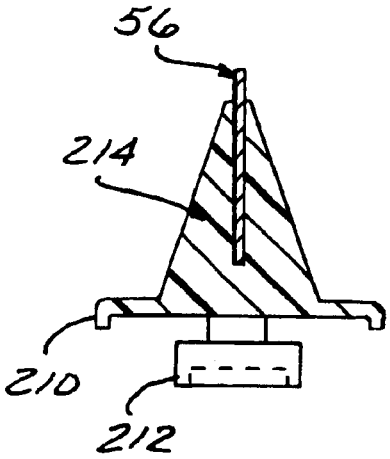
FIG. 21 is a cross-sectional view generally taken along line 21—21 in FIG. 20.
Figure 22:
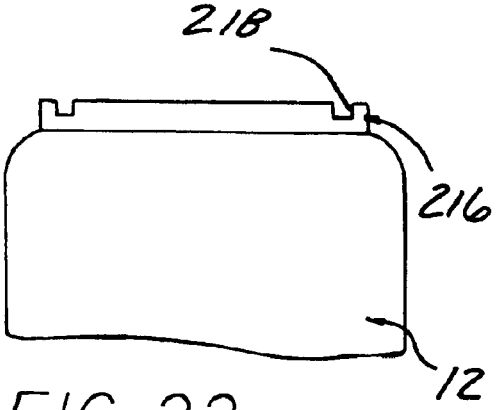
FIG. 22 is an end view of a boot and an outsole usable with the holder shown in FIGS. 20 and 21.
Figure 20:
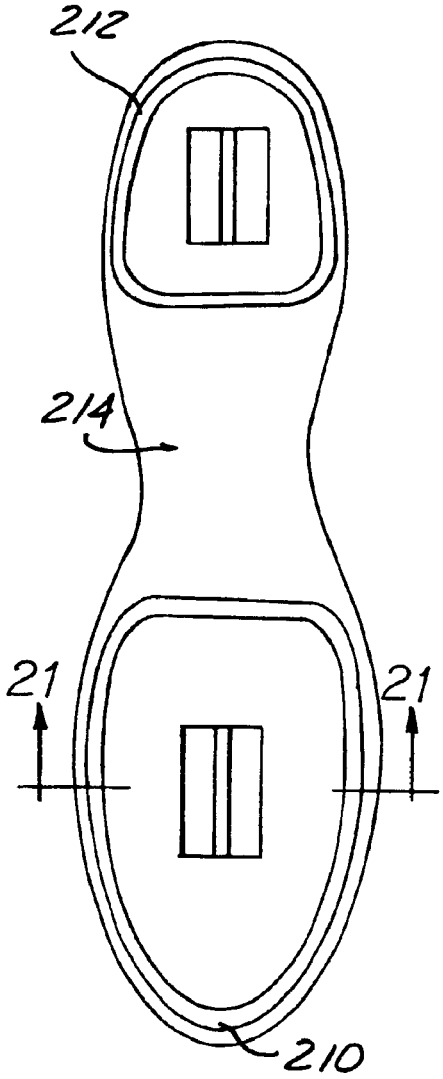
FIG. 20 is a plan view of a holder according to another aspect of the present invention.

In the aspect of the invention shown in FIGS. 20–22, a toe projection 210 and a heel projection 212 on a holder 214 are formed as continuously closed surfaces, spaced apart by a center portion of the holder 214. The outsole 216, in this aspect of the invention, has complimentary formed recesses in the toe and heel portions of the outsole 216, with only the toe recess 218 being depicted in FIG. 22. The mating engagement of the recesses 218 and the outsole 216 with the projections 210 and 212 in the holder 214 resist lateral movement of the holder 214 relative the outsole 216.

Figure 25:
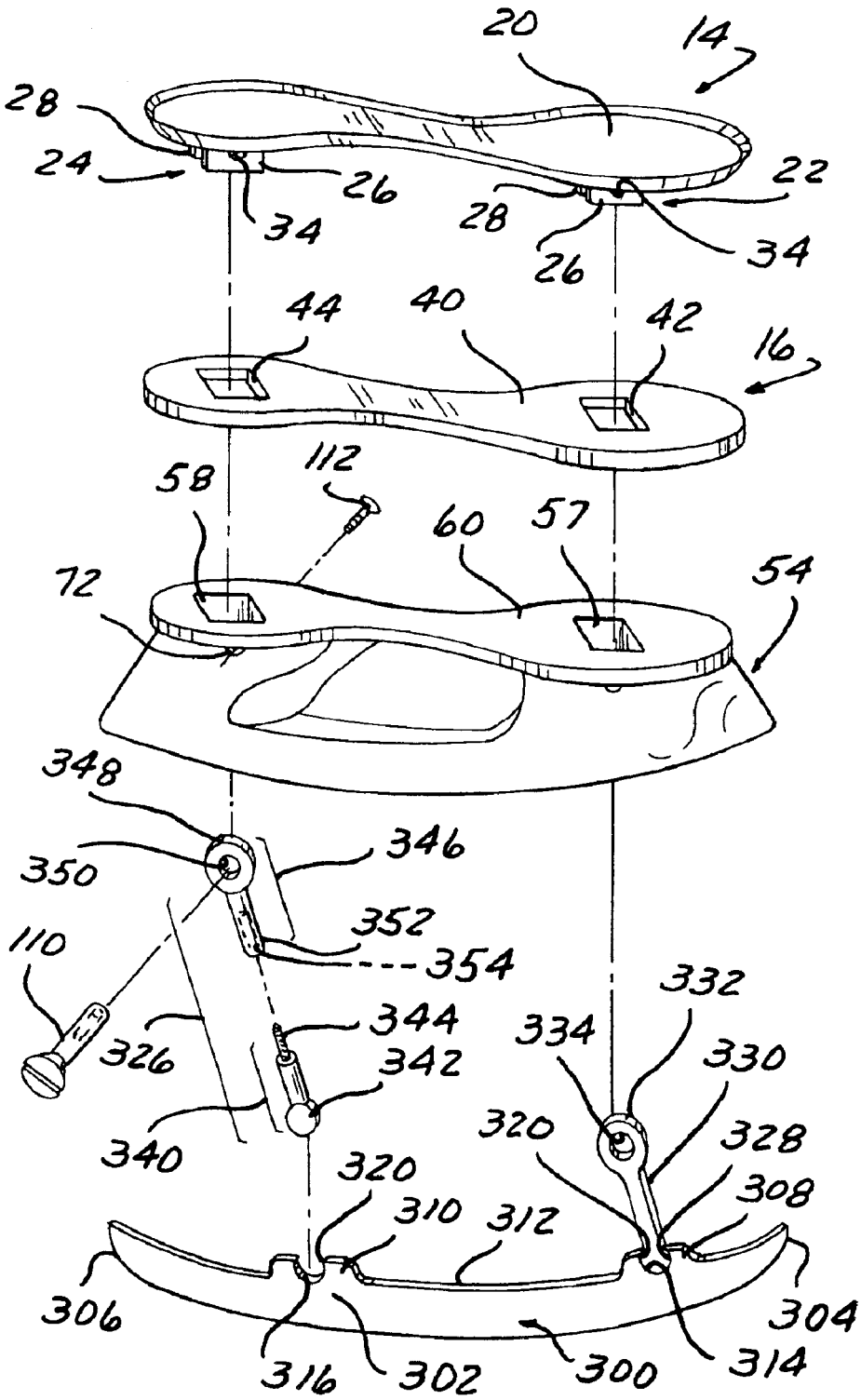
FIG. 25 is an exploded, perspective view of another aspect of the present invention showing optional one and two piece attachment adapters.
Figure 26:
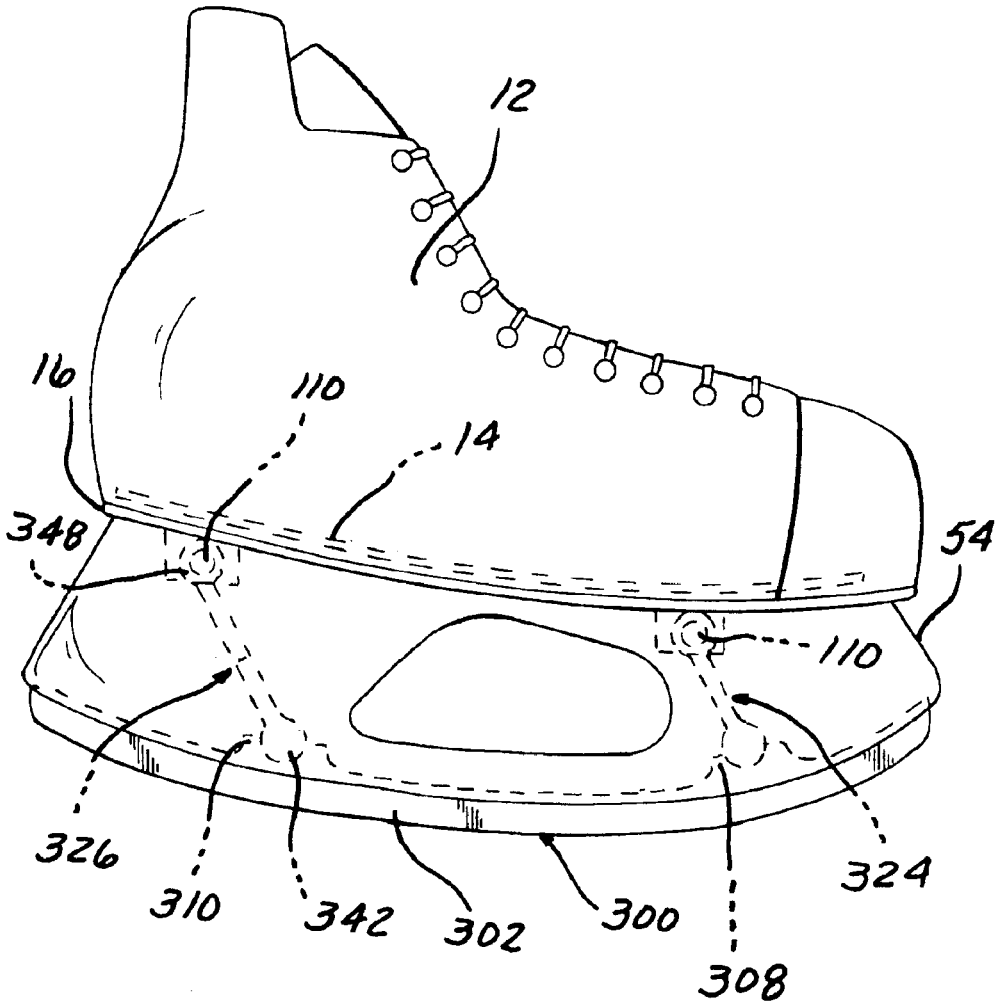
FIG. 26 is a side elevational view of the assembled boot, insole, outsole, holder and blade according to the aspect of the invention shown in FIG. 25.

Referring now to FIGS. 25 and 26, there is depicted yet another aspect of the present invention. In this aspect, the use element or blade 300 is formed with an elongated runner portion 302 extending from a toe end 304 to a heel end 306. Typically, the blade 300 is formed of metal, such as stainless steel. At least one and, preferably, a pair of attachment enlargements or bosses 308 and 310 project integrally from one edge of the runner 300, such as from an upper surface 312 of the runner or blade 300. An attachment aperture 314 and 316 is formed in each boss 308 and 310, respectively. The attachment apertures 314 and 316 have, by example only, a generally circular shape with a larger interior diameter than a shorter width open end 320 at the surface 312 of the blade 300.

The angular orientation of the open end 320 of each attachment aperture 314 and 316 is selected to provide either a straight perpendicular arrangement of a subsequently described attachment fastener adapter or an angular orientation in the same manner as the angular orientation of the blade legs 96 and 98 shown in FIG. 2.

An attachment fastener is employed to attach the blade 300 to the retainers 22 and 24 on the insole 14. FIG. 25 depicts two different attachment fastener constructions 324 and 326, it being understood that a single skate will typically employ the same kind of attachment fastener 324 or 326; although the two different fasteners may also be employed.

The attachment fastener 324 is in the form of a solid, one piece, integral fastener having an enlarged first, solid head end 328, a shank 330 and an opposed second head end 332 having a laterally extending through aperture 334. The attachment fastener 324 has a generally planar shape as shown in FIG. 25. The second head 332 is adapted to be disposed between the retainer legs 26 and 28 of either retainer 22 or 24 on the insole 14. In this orientation, the through bore 334 is aligned with the apertures 34 in the retainer legs 26 and 28 for receiving the fastener portions 110 and 112 therethrough.

Any of the other fasteners described above in different aspects of the invention may also be employed to secure the attachment fastener 324 to the insole 14. In this manner, the replaceable blade 300 is attached to the blade holder 54 which provides lateral reinforcement to the blade and the insole 14 which is fixedly mounted on the boot sole.

FIG. 25 also depicts the optional two part fastener 326. The fastener 326 includes a first section 340 having a first head 342 and smaller diameter threaded shank 344. A second section 346 has an enlarged head 348 with a through bore 350 and a shank 352 having a threaded interior bore 354 sized to threadingly receive the threaded end of the shank 344 on the first section 340. The first head 342 is inertable into one of the attachment apertures 314 and 316 in the blade 300. The opposed second head 348 on the second section 346 is insertable through the retainer legs 26 and 28 for receiving the fastener 110 and 112 as described above.

Typically, the two part fastener 326 will be securely threaded together before attachment to the blade 300 and the insole 14. However, alternate assembly processes wherein the first section 340 is mounted in the blade before the second section 346 is threaded thereonto so as to enable minor adjustments in the overall length of the fastener 326 to be made, is threaded to the first section 340.

The various embodiments of the skate of the present invention make use of retainer legs on an insole which extend through apertures in an outsole. In this construction, the lower edges of the boot are fixedly secured to and sandwiched between the insole and the outsole. The present invention also contemplates forming the retainer legs directly on the outsole attached to the boot. In this type of construction, the insole would define a generally continuous surface member disposed interiorly within the boot. The lower edges of the boot may still be fixedly secured to the outsole and the insole. However, the retainer legs do not, extend from the insole to the outsold. However, the retainer legs function in the same manner as described above insofar as being releasably securable by means of fasteners to the legs projecting from the runner of the blade through the holder.

In summary, there has been disclosed a skate having a unique removable blade wherein the blade is easily attachable to the boot insole for secure attachment; while still enabling easy removal for repair or replacement of a worn or broken blade.

What is claimed is:

1. A skate comprising:

a boot having a sole;

at least one retainer extending from the sole, a bore formed in the at least one retainer transverse to a length of the sole;

a holder mountable to the at least one retainer, an opening formed in a bottom portion of the holder, the holder having bores extending transverse to the opening;

a blade having a runner portion mountable in an open-ended groove in the holder;

an attachment fastener coupled to the blade at one end and having a bore at an opposite end, the attachment fastener extending through the holder; and a fastener extending through aligned bores in the holder, the attachment fastener and the retainer to securely connect the blade and the holder to the boot.

2. The skate of claim 1 wherein the fastener further comprises:

a pin carrying at least one biased lock member, the lock member forcibly engagable with the holder to retain the blade to the holder and the holder in the boot.

3. The skate of claim 1 wherein the outsole further comprises:

a pair of apertures receiving the first and second retainers there through, respectfully.

4. The skate of claim 1 wherein:

the at least one retainer includes first and second spaced retainers extending from the sole, aligned bores formed in each of the first and second retainers transverse to a length of the sole; and the attachment fastener includes a pair of attachment fastener each having solid head end and an opposed second head end, the opposed end of each of the first and second attachment fasteners respectively mounted in the first and second retainers.

5. The skate of claim 1 wherein the blade further comprises:

a recess formed in the blade, the one end of the attachment fastener mounted in the recess.

6. The skate of claim 1 wherein the holder further comprises:

at least one first interior chamber extending from an upper surface of the holder, with the at least one attachment fastener disposed in the first chamber when the holder is engaged with the boot sole.

7. The skate of claim 4 wherein the holder further comprises:

the first and second interior chambers extending from an upper surface of the holder, with first and second retainers disposed in the first and second chambers, respectively, when the holder is engaged with the outsole.

8. The skate of claim 7 wherein the first and second retainers extend longitudinally over substantially all of a toe portion and a heel portion, respectively, of the insole.

9. The skate of claim 1 further comprising:

a plurality of recesses formed on one of the outsole and the holder laterally inward of the periphery of the one of the outsole and holder; and a plurality of projections, complimentary in shape and location to the recesses, formed in the other of the outsole and the holder for mating engagement with the recesses when the holder is engaged with the outsole.

10. The skate of claim 9 wherein:

the recesses and the projections have a larger longitudinal extent than a lateral extent to resist lateral movement of the holder with respect to the outsole.

11. The skate of claim 1 further comprising:

the bores in the holder having end surfaces, an at least one lock member engagably disposed in the end surface of one of the bores when a pin is mounted in the holder.

12. The skate of claim 11 wherein:

the end surface of bores in the holder define an enlarged diameter surface.

13. The skate of claim 12 wherein:

the enlarged diameter end surface of the bores in the retainer has a conical shape.

14. The skate of claim 2 further comprising:

the at least one lock member including a plurality of lock members carried by the pin.

15. The skate of claim 14 wherein:

the plurality of lock members include two lock members, one lock member disposed adjacent to one of the ends of the pin.

16. The skate of claim 2 further comprising:

a pull member coupled to the pin to facilitate pulling removal of the pin from the aligned bores in the holder, the retainers and the blade.

17. The skate of claim 2 further comprising:

a biasing spring carried in the pin for normally biasing the at least one lock member outward from an exterior surface of the pin.

18. The skate of claim 1 wherein the adapter comprises:

a shank having opposed first and second ends, the first end enlarged with respect to the shank; and an open ended recess formed in the blade, the first end of the attachment fastener coupled to the recess.

19. The skate of claim 18 wherein:

the at least one open ended aperture and the runner includes two longitudinally spaced apertures, each receiving one end of a pair of attachment fasteners.

20. The skate of claim 18 further comprising:

the transverse bore extending through the second end of the shank.

21. The skate of claim 1 wherein:

the attachment fastener is a one piece integral member.

22. The skate of claim 1 wherein:

the attachment fastener is a two piece member formed of first and second engagable portions.

23. The skate of claim 22 wherein:

the first and second securable portions are threadingly engagable.

24. The skate of claim 18 further comprising:

the at least one recess in the blade having an open end with a smaller width than an inner diameter of the recess, the open end receiving the shank of the attachment fastener adapter, the inner diameter receiving the enlarged head at the first end of the attachment fastener.

25. The skate of claim 18 wherein the first end of the shank and the recess in the blade are complimentary in shape.

* * * * *